United States Patent [19]

Widenbäck

[11] Patent Number: 4,945,713

[45] Date of Patent: Aug. 7, 1990

[54] METHOD AND APPARATUS FOR PACKETING OBJECTS IN A CHAIN OF BAGS

[75] Inventor: Ralph Widenbäck, Stenungsund, Sweden

[73] Assignee: New Pac Systems AB, Sweden

[21] Appl. No.: 275,066

[22] Filed: Nov. 21, 1988

[30] Foreign Application Priority Data

Nov. 24, 1987 [SE] Sweden ..... 8704666

[51] Int. Cl.[5] ..... B65B 5/02; B65B 7/06; B65B 9/08; B65B 43/26

[52] U.S. Cl. ..... 53/459; 53/385; 53/469; 53/570; 493/198

[58] Field of Search ..... 53/202, 459, 567, 568, 53/570, 384, 385, 386, 469; 493/194, 195, 198

[56] References Cited

U.S. PATENT DOCUMENTS

| | | | |
|---|---|---|---|
| Re. 28,350 | 3/1975 | Lerner | 53/459 |
| 2,195,740 | 4/1940 | Salfisberg | 53/459 X |
| 2,612,738 | 10/1952 | Salfisberg | 53/459 |
| 2,671,587 | 3/1954 | Vogt | 53/570 X |
| 2,671,588 | 3/1954 | Vogt | 53/570 X |
| 3,254,468 | 6/1966 | Lerner | 53/459 |
| 3,599,388 | 12/1968 | Feingold | 53/455 |
| 3,779,449 | 12/1973 | Membrino | 53/459 X |
| 4,229,928 | 10/1980 | Münchinger et al. | 53/452 |
| 4,378,666 | 4/1983 | Onishi | 53/570 |
| 4,798,041 | 1/1989 | Bentsen | 53/459 X |

FOREIGN PATENT DOCUMENTS

| | | | |
|---|---|---|---|
| 2649777 | 5/1978 | Fed. Rep. of Germany | 53/459 |
| 2533892 | 4/1984 | France . | |

*Primary Examiner*—Robert L. Spruill
*Assistant Examiner*—Beth Bianca
*Attorney, Agent, or Firm*—Ostrolenk, Faber, Gerb & Soffen

[57] ABSTRACT

Objects are packeted in bags (5) by means of a chain (1) of flat, flexible bags being conveyed, open at the top, through a filling station (12). Each bag in the chain has a rear main wall with a lip protruding from the opening, out past the edge of the front wall (51). In the station the lip is allowed to run along a support line which, seen in the general direction of feed of the chain of bags, diverges therefrom both horizontally and vertically so that the opening of the bag (5) can easily be opened by a jet of air without creasing the chain of bags.

23 Claims, 1 Drawing Sheet

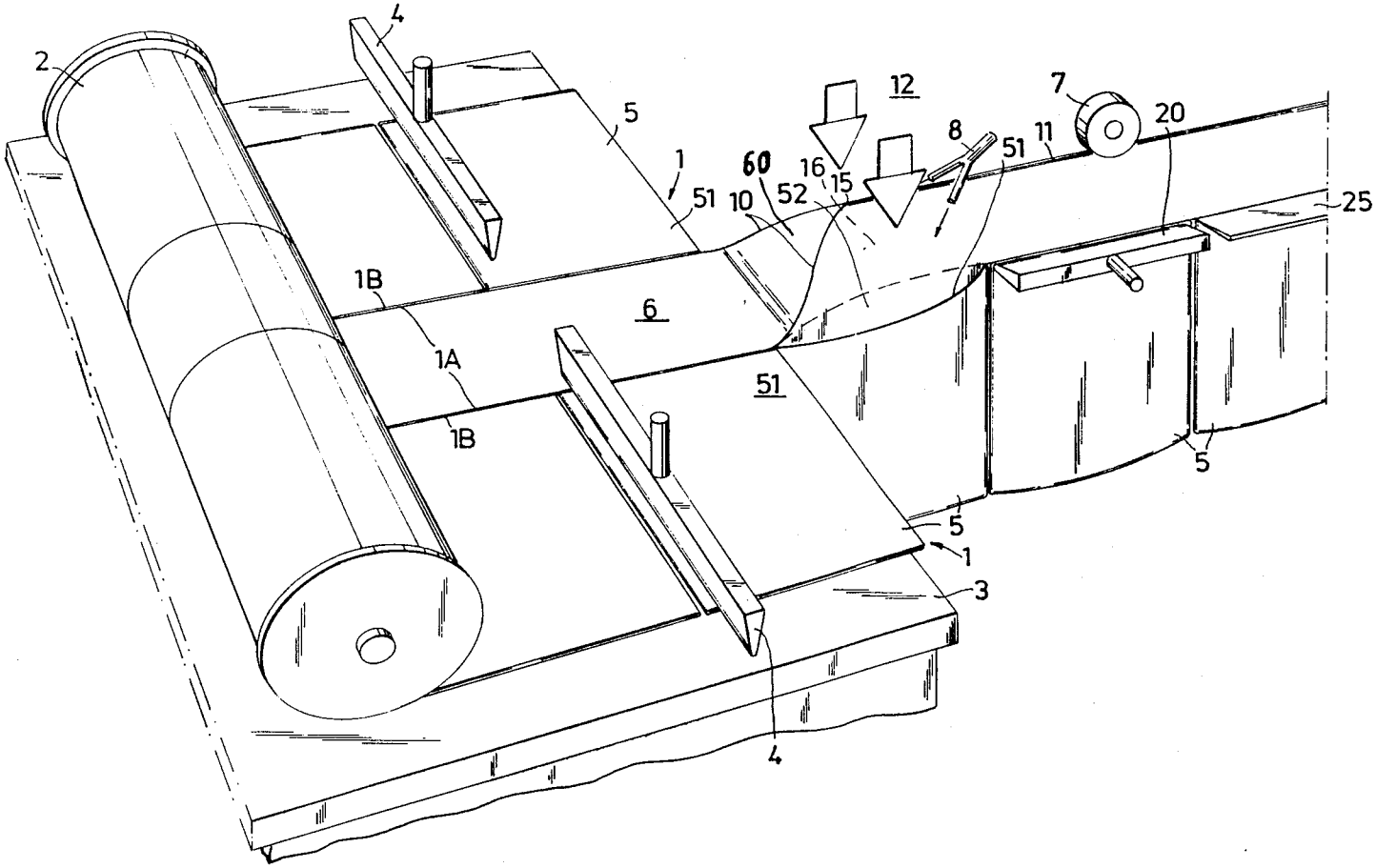
25
20
7
11
51
8
12
15
16
52
60
10
51
1
5
6
5
1
3
51
4
4
1A
1B
1B
2

METHOD AND APPARATUS FOR PACKETING OBJECTS IN A CHAIN OF BAGS

The present invention relates to a method of packeting objects in bags, wherein a chain of flat, flexible bags is conveyed through a filling station where the mouth of a bag is opened for insertion of an object. The invention also relates to an apparatus for performing the method.

In order to packet objects in bags it is advantageous to arrange the bags continuously in the form of a chain which is conveyed past a station where the bags are opened and the objects inserted, after which the bags can be sealed and separated from each other. The bags should preferably be made of flat, plastic film.

However, innumerable problems are entailed in such a method of packeting.

One of the main problems is how to open the bags in a reliable manner without the bags or the chain of bags being subjected to too much strain and without creasing.

Another problem is how to reliably hold or support the bags/chain of bags in conjunction with the opening and sealing process.

Said problems include the difficulty of permitting the front and rear edges of the bag to approach each other in the filling station.

Yet another problem is finding a simple way of varying the size of the bag, i.e. the dimension of the bags in longitudinal direction of the chain, or of working with bags of different sizes in one and the same packeting machine.

There is also the problem of being able to reliably and easily open the bags.

One object of the invention is to offer a method substantially eliminating or at least greatly reducing at least some of said problems.

This object is achieved by the method according to a first embodiment of the invention which substantially comprises using a chain of identically oriented flat bags, the bags being supported in the filling station via one lip of the opening along a section of the transfer track which is curved in a plane normal to the longitudinal axis or neck of the bag.

By inclusion of a curved section of transfer track in the filling station, along which one main surface of the flat bag moves, the shortest distance between the front and rear edges of the bag will be shorter than the length of the bag along the curved section of the transfer track. The bag aperture can then easily be opened by means of a jet of fluid, i.e. the free lip will be moved away from the secured lip. Such a fluid jet can be produced in conventional manner by an air nozzle. When an object has been inserted in the bag thus opened in the filling station, the following section of the transfer track may be substantially straight, whereupon the lips of the bag will be brought together, allowing the bag to be easily symmetrically sealed. An expert will understand that the sealing operation does not constitute any great problem.

The chain of bags may suitably be designed to cooperate with drive means transporting the chain along the transfer track. In this case the chain of bags may be provided with a series of perforations along the free edge of the one supported lip of the bags, spikes on the transport chain engaging in said perforations enabling the chain of bags to be supported and driven along a path defined by a guide for the chain.

If packeting is to be acceptable the orientation of the bags in relation to the direction of movement of the chain must be substantially constant. According to a simple embodiment of the method according to the invention the transfer track may be located in a single plane, e.g. a horizontal plane, in which case the two sections of the transfer track adjoining the curved section of transfer track will have different directions in this plane.

According to an alternative embodiment of the invention, where the direction of movement of the chain is such that the direction of movement of the bags in the plane of the chain of bags is constant, the chain of bags is arranged to be transported along a substantially straight track. The significance of this will be revealed in the following.

According to the alternative embodiment, said curved section of transfer track is also curved in a plane perpendicular to said normal plane and substantially encompasses the general direction of transport of the chain of bags. This means that the bags in the station are supported by one lip of the opening, along a support line which, seen in the general direction of travel of the chain of bags, diverges therefrom in two planes perpendicular to each other, encompassing the direction of travel. Assuming the bags are suspended in a vertical plane and are being transported horizontally, the support line will then form an S-bend in both vertical and horizontal plane.

As long as a single chain of bags of the type mentioned earlier is used, together with the transport means also mentioned earlier, the further development according to the invention will result in the general direction of travel for the bags being substantially straight. However, the following possibility is also offered and is exploited according to the preferred embodiment of the invention. Considerable advantages are thus obtained by duplicating the chain of bags so that figuratively speaking the chain is composed of "saddlebags" joined together, and by duplicating the further development according to the invention, i.e. by arranging two parallel, symmetrical "S"-shaped supporting lines. A first advantage is that no perforations or spiked transport chains or the like are required to support the chain of bags; the "duplicate" chain of bags will run symmetrically on the "duplicate" support lines.

A fundamental feature of the general inventive concept is that the curved section of transfer track permits bags of different lengths to be opened. This enables objects of varying length to be packeted in a chain without having to readjust the apparatus to open then bags.

Suitable starting material for the chain of bags might be flat, tubular film wound to form a roll, said tubular film having two central, parallel weldings running longitudinally, the upper layer of the tube being provided with longitudinal slits outside each longitudinal weld. Bags are then formed in the starting material, preferably in pairs opposite each other, by producing transverse welds in the outer edge portions of the material and separating between these transverse welds. Obviously the length, in longitudinal direction of the tubular material, of the bags thus formed can easily be varied. These bags of varying length can be opened in the filling station without difficulty and without readjusting the apparatus, providing the variation in length is kept within reasonable limits.

The preferred embodiment of the invention, defined in the accompanying claims, will be described with reference to the example shown in the accompanying drawing.

The accompanying drawing shows schematically and in perspective the preferred embodiment of the apparatus according to the invention.

The drawing shows two chains 1 of bags, together formed from a flat tube of a film of plastic, paper or the like having two parallel weld lines lA arranged centrally and running longitudinally. Outside these weld lines on each side of the tube are cuts lB in the upper layer of the tube. Material prefabricated in this manner can be on a storage roll 2 and be pulled out from the roll over a table 3. Transverse sealing jaws 4 are also shown on the table which, as shown in the drawing, produce transverse sealing seams in the edge portions of the two strips 1, simultaneously establishing a central cut to form individual bags 5 which are separated in the example by a central strip 6 of double foil. It may be assumed that the table 3 is horizontal and the strips 1 are moved along by a drive roller 7 operating against a support for the two connected strips 1, moving them generally to the right in the drawing. Two support lines 10, starting from the right hand edge of the table 3 converge while rising to a level higher than the surface of the table 3, the distance between the lines narrowing for instance from the distance between the cuts lB to an optional distance 11. This distance must under all circumstances be narrower than the central strip 6.

When the strip 6 runs up onto the lines 10 the bags will fall down and hang substantially vertically, the adjacent main walls of the bags 5 thus approaching each other since the lines 10 approach each other as seen in horizontal plane. However, the outer wall 51 of the bags can easily be separated from the inner wall 52 in the filling station, defined by the area where the supporting lines 10 converge and the area immediately after, since the shortest distance between the front and rear edges of the bags 5 is less than the width of the front wall surface 51 of the bags. A conventional nozzle 8 may be arranged at the filling station 12, blowing air towards the bags opening, to assist in separating the outer wall 51 from the inner wall 52.

A wall 16 may suitably be arranged extending vertically in the example from the supporting line 10 and extending forward a suitable distance in the direction of travel of the bags. The bags will then be effectively opened even if the gas flow from the nozzles 8 is slight.

It will be understood that the bags 5 can easily be opened pairwise since the arrangement is preferably symmetrical and the objects inserted into the opened bags at station 12 will therefore load them equally. The two chains of bags will therefore balance each other across the spine 15 established by the continuation of the supporting lines 10. It will be understood that if the supporting lines 10 converge along a distance of for instance half the width of the bags shown, the apparatus can still be used for opening bags of much greater width.

The drawings also show transverse sealing members 20 which seal the filled bags, assumed to be hanging on straight, parallel, horizontal supporting edges subsequent to the filling station so that the bags filled in the station 12 actually have a tendency to close automatically.

A separating member 25 may follow the transverse sealing member 20 to separate the cushionlike packages 5 now formed from the central strip 6.

It will be understood that the arrangement according to the invention, with supporting lines 10 converging from the direction of feed in two planes perpendicular to each other produces the effect that the bags 5 will not be turned in relation to each other in their plane. This advantage is important since troublesome creasing would otherwise occur.

The explicit example shown is a practical embodiment of the method according to the invention and variations, modifications and deviations from the example are feasible within the scope of the accompanying claims.

One skilled in the art would thus realize that the apparatus illustrated is symmetrical so that a single chain of bags 1 could be filled by suitable modification of the method in order to provide support. In a further embodiment of the present invention, it is thus feasible to retain (means not shown) the rear wall 52 of the bags protruding up past the free edge of the front wall 51, and guide the bag along a support line corresponding first to the cut lA, then the edge 10, and finally the edge 15. This might be achieved, for instance, by perforating the free edge of the rear wall 52 to cooperate with spikes on a transport chain running in the middle of the strip 6 in the plane produced by the lines 10. It will be understood that the chain of bags 1 would enter and leave the station 2 in substantially the same direction. To further generalize, the chain of bags could enter and leave the filling station in different directions in the horizontal plane in the example, in which case it would be sufficient for the edge 10 to be curved in the horizontal plane.

Obviously the method according to the invention offers advantages in the production of the individual bags, thanks to the transverse sealing and cutting effected by the jaws 4 and the sealing effected by the jaw 20, since each bag 5 and thus the entire chain of bags can be allowed to stop for a moment in the station 12 immediately after the rear edge of the bag has left the edge of the table 3. The bag thus has time to assume a vertical position and also to be opened before an article can be inserted into the bag. During this period of inactivity for the chain, the two jaws 4 and 20 can operate in a favourable manner, particularly since the bag material consists of plastic film and sealing is effected by heat treatment, as the plastic material has time to stabilize before the next operation.

Another favourable feature of the invention is that the individual bags in the chain can be opened without varying the direction of movement in longitudinal extension.

In principle, therefore, the chain 1 could be fed at constant speed through the apparatus shown, the bags being filled as they passed through the station. Another important feature is that the individual bags are not twisted and no unfavourable creasing therefore occurs.

The mid-strip in the preferred embodiment shown is conveyed via a shaping head 60 which is defined by converging supporting lines 10 and, generally shaped like a tetrahedron. A chain of "saddlebags" is produced so that two bags can be dealt with simultaneously in each station.

Since the supporting lines 10 at the start of the filling station "lift" the bag at the same rate as the bag approaches the plane of symmetry of the apparatus, the orientation of the bag in relation to its direction of travel can be maintained so that strain on the bag is minimized.

The spine 15 adjoining the edges 10 is suitably aligned to maintain the orientation of the bags, i.e. so that the rim of the bags (even when the bag is open) lies substantially in one plane throughout its passage through the station 12, and suitably also in the sealing station.

The jaws 4 are suitably shaped conventionally to produce a slit between two adjacent sealing seams.

The chain of bags can be guided laterally, e.g. by a strip of foil welded to the mid-strip 6. The edges of the foil strip can then be folded up and guided in a channel extending along the table, through station 12 and on. The foil strip may of course be formed by the flat tube from which the chain of bags is produced, i.e. of the upper layer of foil between the lines lA.

I claim:

1. An apparatus for packeting objects in bags comprising:

two chains of bags, and a central strip transversely separating said chains of bags, said central strip having opposite edges, with each said edge being secured to one of said chains of bags;

each of said bags having an inner wall, said inner wall having a secured lip, said secured lip of each said bag being attached to the respective edge of said central strip for the said chain of the said bag;

each said bag having an outer wall, said outer wall having a free lip; an aperture being defined between said inner and outer walls to receive objects to be packeted;

an elongated transfer track for said central strip to be transported along, said transfer track having opposite sides and including a shaping head having a pair of spaced support edges which start upstream in the direction of transportation as separated by a first distance and rise below said central strip for lifting said central strip; said support edges converge as they rise in the direction of transport to be spaced a second distance apart which is less than the width of said central strip and to form a spine in said central strip between said edges thereof, said spine extending in the direction of transport, whereby as said central strip travels on said support edges, it supports said bags by their respective said secured lips so that each said chain of bags travels along a respective said opposite side of said transfer track;

each of said support edges having a respective rising bend which converges toward said other bend of the other said support edge for separating each said bag outer wall from said bag inner wall as they pass over said bends to allow access to the interiors of said bags, said bends being oriented so that the lengths of said apertures of said bags traveling along said bends are made less than the lengths of said inner walls of said bags traveling along said bends to separate said outer walls from said inner walls;

means for transporting said bags along said transfer track; and, means for packeting said bags after said outer walls are separated from said inner walls of said bags.

2. The apparatus as claimed in claim 1, wherein said edges of said shaping head substantially define adjacent edges of a tetrahedron.

3. The apparatus as claimed in claim 1, further comprising a blow-nozzle aimed to blow toward said apertures for separating of said free lips from said secured lips of said bags.

4. The apparatus as claimed in claim 1, wherein said chains of bags are arranged in mirror symmetry around said central strip and each is supported by a said support edge, and said support edges are arranged substantially symmetrically.

5. The apparatus as claimed in claim 1, wherein said bends of said transfer track converge and rise in the vertical and horizontal planes to lift said central strip in the direction of bag chain transport.

6. The apparatus as claimed in claim 5, wherein said bends are rising and converging S-bends.

7. The apparatus as claimed in claim 1, wherein said transfer track is shaped such that said bags are transported along said transfer track from substantially horizontal to substantially vertical orientation.

8. The apparatus as claimed in claim 7, wherein said pair of support edges converge and rise to a level higher than a level in which said bags are substantially horizontally oriented.

9. The apparatus as claimed in claim 1, wherein said support edges converge to a substantially parallel orientation on said spine.

10. The apparatus as claimed in claim 1, further comprising a support wall extending vertically beneath said support edges for supporting said inner walls of said bags as said bags travel along said transfer track.

11. The apparatus as claimed in claim 1, wherein said support edges rise and converge over a distance in the transport direction equal to at least half the length of said bags.

12. The apparatus as claimed in claim 1, wherein said central strip and said support edges are so shaped and so positioned that said central strip is folded over said support edges to cause said inner walls of said chains of bags to approach each other until they are arranged in substantially parallel orientation.

13. The apparatus as claimed in claim 1, further comprising a roll of flat, tubular film to form said chains of bags, said tubular film including an upper layer and a lower layer to define said outer walls and said inner walls, respectively, of said bags, and two central, parallel welds running longitudinally and bordering said central strip to define said secured lips of said bags, said upper layer of said tubular film being provided with longitudinal slits outside each of said longitudinal welds to define said free lips of said bags.

14. The apparatus as claimed in claim 13, wherein said roll of flat, tubular film includes means to laterally separate each bag within said chains of bags.

15. The apparatus as claimed in claim 14, wherein said means to laterally separate includes transverse sealing jaws to produce transverse cuts through said tubular film to produce separate edge portions of each of said bags.

16. A method of packeting objects in bags comprising:

providing two chains of bags, each chain being secured to a respective opposite edge of a central strip, wherein each said edge is secured to one of said chains of bags by:

rolling said chains of bags separated by the central strip into a roll of flat, tubular film, said film including an upper layer and a lower layer to define outer walls and inner walls, respectively, of said bags and prior to said rolling forming two central, parallel welds running longitudinally, bordering said central strip for defining a secured lip on the inner wall of each of said bags, said secured lip of each said bag being attached to the respective edge of said central strip for the said chain of that said bag and forming a longitudinal slit in said upper layer of said tubular film to define a free lip on the outer wall of each of said bags; an aperture being defined between said inner and outer walls to receive objects to be packeted;

transporting said bags and said central strip along an elongated transfer track extending in the direction of transport;

supporting said bags from said central strip when said central strip travels along support edges of said track to transport said bags along the edges of said transfer track, said central strip supporting said bags by their respective secured lips on opposite sides of said transfer track;

separating said outer walls from said inner walls of said bags for opening the apertures by decreasing the distance between the edges of said bags traveling along a portion of said track relative to the lengths of said inner walls of said bags traveling along that said portion of said track;

packeting said bags with articles to be contained.

17. The method as claimed in claim 16, further comprising sealing the apertures of said bags after packeting said bags.

18. The method as claimed in claim 17, further comprising blowing air at said bag apertures to facilitate the separation of said outer walls from said inner walls of said bags.

19. The method as claimed in claim 17, further comprising laterally separating each bag within each of said chains of bags.

20. An apparatus for packeting objects in bags comprising:

an elongated transfer track for a central strip and two chains of bags attached to the strip to be transported along; said transfer track having opposite sides and including a shaping head having a pair of spaced support edges which start upstream in the direction of strip transport as separated by a first distance and rise below the central strip for lifting it and converge as they rise in the direction of transport of the strip to be spaced a second distance apart which is less than the width of the central strip to form a spine in the central strip between said edges the strip extending in the direction of transport;

each of said support edges having a respective rising bend and converging toward said other bend for separating the outer wall of a bag from the inner wall thereof as they pass over said bends to allow access to the interiors of the bags, said bends being oriented so that the lengths of the apertures of said bags traveling along said bends are made less than the lengths of the inner walls of said bags traveling along said bends to separate the outer walls from the inner walls;

means for transporting the bags along said transfer track; and, means for packeting the bags after the outer walls are separated from the inner walls of the bags.

21. The apparatus as claimed in claim 20, wherein said bends are rising and converging S-bends.

22. The apparatus as claimed in claim 20, wherein said bends of said transfer track converge and rise in the vertical and horizontal planes to lift the central strip in the direction of bag chain transport.

23. The apparatus as claimed in claim 20, further comprising a support wall extending vertically from said support edges to support the inner walls of the bags when the bags travel along said transfer track.

* * * * *